US006782666B1

(12) United States Patent
Condon et al.

(10) Patent No.: US 6,782,666 B1
(45) Date of Patent: Aug. 31, 2004

(54) APPARATUS FOR COVERING EXPOSED RAFTERS

(76) Inventors: Christopher Condon, 4 Ridge Cliff Ct., Irmo, SC (US) 29063; Jonathan Ward Buzzell, 421 Ivy Green La., Lexington, SC (US) 29072

( * ) Notice: Subject to any disclaimer, the term of this patent is extended or adjusted under 35 U.S.C. 154(b) by 0 days.

(21) Appl. No.: 10/263,529

(22) Filed: Oct. 3, 2002

Related U.S. Application Data

(60) Provisional application No. 60/338,517, filed on Dec. 3, 2001.

(51) Int. Cl.[7] ..... E04B 7/04

(52) U.S. Cl. ..... 52/93.2; 52/94

(58) Field of Search ..... 52/716.1, 717.05, 52/718.01, 717.06, 58, 94, 96, 97, 302.1, 302.3, DIG. 8, 738.1

(56) References Cited

U.S. PATENT DOCUMENTS

| | | | | |
|---|---|---|---|---|
| 2,204,617 A | | 6/1940 | Peel et al. | |
| 3,994,104 A | * | 11/1976 | Gurrola | 52/91.1 |
| 4,279,112 A | * | 7/1981 | Bertrand | 52/741.4 |
| 5,560,157 A | * | 10/1996 | Rotter | 52/95 |
| 5,636,490 A | * | 6/1997 | Stocksieker | 52/556 |
| 5,829,206 A | | 11/1998 | Bachman | |
| 5,927,023 A | | 7/1999 | Kittilstad | |
| 5,946,864 A | | 9/1999 | Simpson | |
| 6,035,586 A | | 3/2000 | Leslie et al. | |
| 6,226,956 B1 | * | 5/2001 | Davis et al. | 52/745.06 |

FOREIGN PATENT DOCUMENTS

| | | | | |
|---|---|---|---|---|
| GB | 2374354 A | * | 10/2002 | 52/95 |

* cited by examiner

*Primary Examiner*—Carl D. Friedman
*Assistant Examiner*—Naoko Slack
(74) *Attorney, Agent, or Firm*—Michael A. Mann; Nexsen Pruet Adams Kleemeier, LLC

(57) ABSTRACT

The present invention is an apparatus that provides both a protective and a decorative covering, or sleeving, for rafters. Generally, the apparatus is a U-shaped sleeve that has upper and lower horizontal flanges that run the entire longitudinal length of the member. The upper flange provides a means for securely attaching the invention to roofing materials such as roof sheathing, and together with the bottom flange forms an external channel that can be used to carry soffit material between the rafters. Furthermore, to complete the coverage and, therefore, the protection afforded the exposed rafter by the present invention, an endcap is attached to the outer end of the U-shaped sleeve member. Additionally, to further enhance the appearance of the building, the rafter sleeving is designed to easily and securely carry decorative trim and/or molding pieces.

18 Claims, 4 Drawing Sheets

FIG. 3A
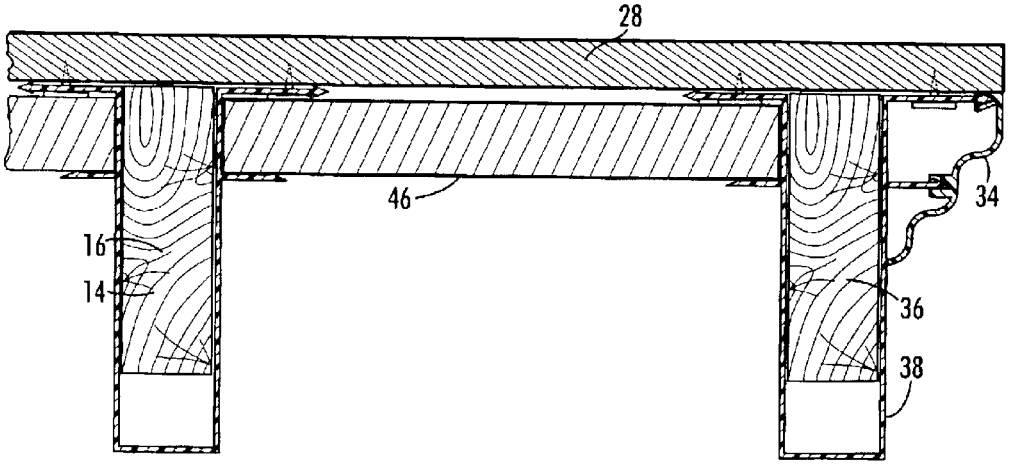
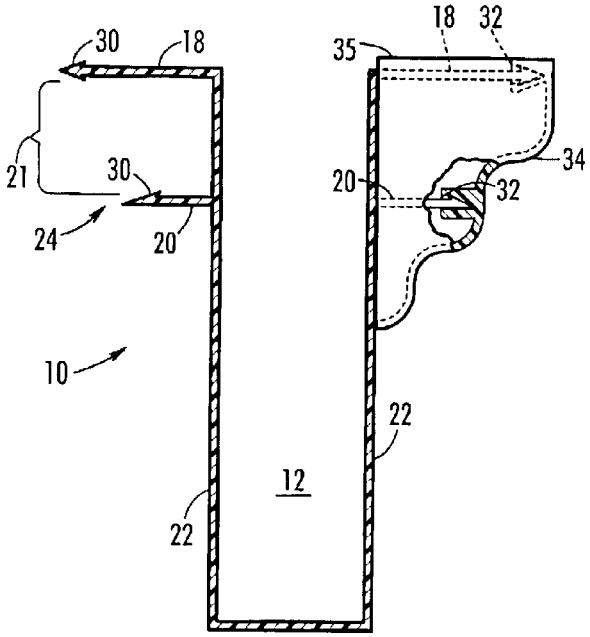
FIG. 3B
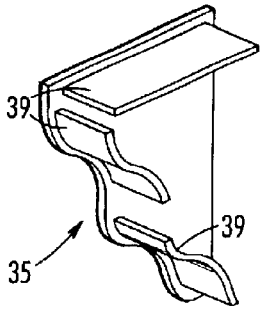
FIG. 3C

APPARATUS FOR COVERING EXPOSED RAFTERS

CROSS-REFERENCE TO RELATED APPLICATIONS

The inventors claim the priority benefit of U.S. provisional patent application serial No. 60/338,517, filed Dec. 3, 2001, which is incorporated herein by reference.

STATEMENT REGARDING FEDERALLY SPONSORED RESEARCH OR DEVELOPMENT

Not applicable.

REFERENCE TO A MICROFICHE APPENDIX

Not applicable

BACKGROUND OF THE INVENTION

The present invention relates to a covering for exposed rafters, and, more specifically, to an essentially maintenance-free and decorative covering, or sleeve, for exposed rafters.

A rafter is generally defined as a sloping roof support, and more specifically defined as any of the sloping supporting timbers, beams, or boards that run from the ridge beam of a roof to its edge.

Many of today's architectural styles rely on the use of exposed rafters, or at least on having significant portions of the rafters exposed, in order to create an appearance or an effect. For example, architectural styles such as "Arts and Crafts," "Bungalow," "Prairie," and "Low-Country" incorporate exposed rafter tails as an important exterior design component. Typically these designs do away with the soffits, fascia boards, and the other related materials that are used in many of the other styles and designs in order to cover, but not necessarily protect, the exposed rafters. Subsequently, the exposed rafters, and even some of the covered rafters, are unprotected from the elements. Since rafters are generally made of wood or wood based products, they are susceptible to accelerated aging, deterioration, and other damage associated with this exposure. This typically requires the owner of the home or building to make costly and oftentimes frequent repairs that can be either cosmetic or structural in nature. And, while the cosmetic repairs may require only simple caulking and/or painting, the structural repairs may be more serious and may require substantial cover-up or repair including unsightly bracing.

An example of prior art related to roof protection is contained in U.S. Pat. No. 5,927,023 issued to Kittilstad. This invention includes not only a roof edge fascia system for securing a rubber membrane against the surface of a roof, but also a means for attaching a decorative cover plate to the securing system described. This invention, however, only covers the parapet, and since it is designed for use with flat roofs it makes no provision for sloping roof lines, which makes this invention inappropriate for standard residential roofs. Another example of roof protection is contained in U.S. Pat. No. 6,035,586 issued to Leslie et al. This invention describes an organic rafter having an adjustable length rafter tail, which allows the user to laterally align an individual rafter tail with the other rafter tails on the same side of the building, and which, arguably, provides a rafter tail having better reinforcement and alignment characteristics. This invention, however, describes a system that completely encloses the rafters of the houses built with that system and, therefore, it is not intended to be used with houses having rafters that are designed to be visually exposed.

Based on the products available to the consumer, a need remains for an apparatus that can be used for covering, protecting, and possibly decorating exposed rafters that is not only economical, but is also easy to manufacture, install, and maintain.

SUMMARY OF THE INVENTION

According to its major aspects and briefly recited, the present invention is an apparatus that provides both a protective and a decorative covering, or sleeving, for the exposed ends of rafters. Generally, the apparatus is a U-shaped sleeve member that has upper and lower horizontal flanges that run the entire longitudinal length of the sleeve. The upper flange provides a means for securely attaching the sleeve to other roofing components, and together with the bottom flange forms an external channel that is perpendicular to the interior channel that can be used for carrying soffit material between the rafters. Furthermore, to complete the coverage and, therefore, the protection afforded the exposed rafter by the present invention, an endcap is attached to the outer end of the U-shaped sleeve member. Additionally, to further enhance the appearance of the building, the flanges, or other portions of the rafter sleeving, are designed to easily, and securely, carry decorative trim and/or molding pieces.

A feature of the present invention is that it can be made of materials such as extruded vinyl or aluminum, which provides many advantages including: being essentially maintenance-free; allowing the invention to be made in a variety of colors and textures; and not requiring the use of complicated and expensive fabricating equipment.

Another advantage of the present invention is that the installation of the present invention requires only those tools, fasteners, materials, and skills that are standard and customary in the siding industry; therefore, no new skills or tools would be required to install the present invention.

Another feature of the present invention is that it can be manufactured in various standardized shapes and sizes, which allows the builder to directly order from stock without the need for special ordering and having to deal with the delays associated with such ordering practice. Additionally, since a rafter sleeve can have a much larger cross section than that required to accommodate the covered rafter, the rafter sleeve can provide the further advantage of being oversized so that it can give a rafter member a more architecturally and aesthetically correct appearance, and at a cost that would be much lower than the cost associated with using larger rafter lumber.

Still another advantage of the present invention is the opportunity for a builder to order the present invention in large lengths from stock, which can then be cut into the lengths and the pitch angle required for the project at the job site.

These and other features and their advantages will be apparent to those skilled in the arts related to home building and siding installation from a careful reading of the Detailed Description of Preferred Embodiments accompanied by the following drawings.

BRIEF DESCRIPTION OF THE DRAWINGS

In the figures,

FIG. 3A is a cross-sectional end view of the rafter sleeve showing the installation of soffit material and decorative molding, according to a preferred embodiment of the present invention;

FIG. 3B is a front end elevational view of the barge rafter sleeve showing a preferred way of attaching decorative trim molding, according to a preferred embodiment of the present invention;

FIG. 3C is a side perspective view of the decorative trim molding endcap, according to a preferred embodiment of the present invention;

DETAILED DESCRIPTION OF PREFERRED EMBODIMENTS

In accordance with the present invention there is described an apparatus for covering, protecting, and potentially decorating an exposed end of a rafter or rafter tail of a roof structure. In the following paragraphs the term "rafter" is defined as: any of the sloping supporting timbers, beams, or boards that run from the ridge beam of a roof to its edge, and as used herein generally refers to members made of wood; however, the rafters may be made of any other suitable organic or inorganic material. In the following paragraphs the term "rafter tail" is defined as: the exposed of the "rafter" that generally extends from a non-gable end outer wall of a building to the outer end of the roof, i.e., the end that is opposite to the top of the roof or the "ridge beam." In the following paragraphs the term "ridge beam" is defined as: the beam along the top of a roof where the two sloping sides meet. In the following paragraphs the term "soffit" is defined as: the underside of a structural component of a building, (for example, the underside of a roof overhang). In the following paragraphs the term "fascia" is defined as: the flat vertical surface immediately below the edge of a roof. In the following paragraphs the term "bargeboard" is defined as: a board attached to the gable end of a roof. In the following paragraphs the term "barge rafter" is defined as: the end "rafter," i.e., the "rafter that is located at the gable end of the roof. In the following paragraphs the term "gable" is defined as: a side wall that comes to a peak where the slopes of a pitched roof meet. As used in the following paragraphs a "barge rafter" is the two "rafters" at each gable end of the roof or building. When the term "cover" (or forms of that term) is used herein for describing how a rafter sleeve is used to extend over the surface of a standard rafter or a barge rafter, it is generally intended to mean that the rafter sleeve extends over the exposed surfaces of the standard rafter or the barge rafter, i.e., the rafter sleeve will extend over the bottom and both vertical sides of the standard rafter or the barge rafter, and not the top which is covered by the roof sheathing.

Figure 1:
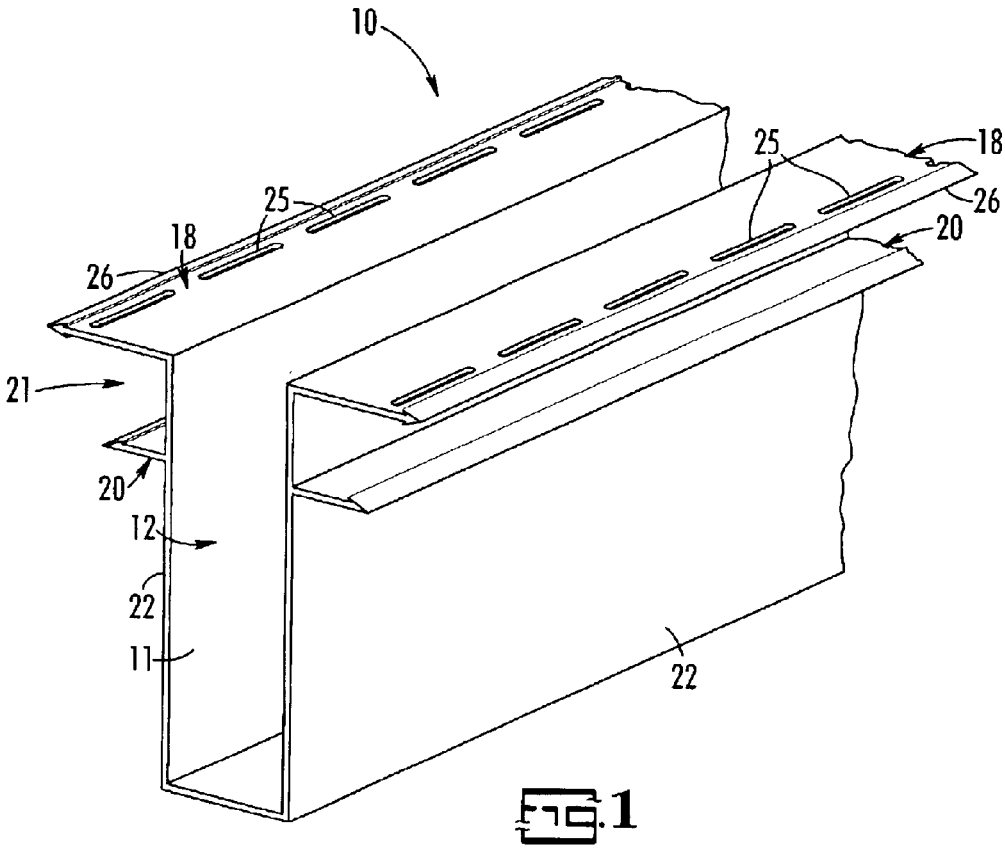
FIG. 1 is a perspective view of one of the ends of a rafter sleeve, according to a preferred embodiment of the present invention.
Figure 2:
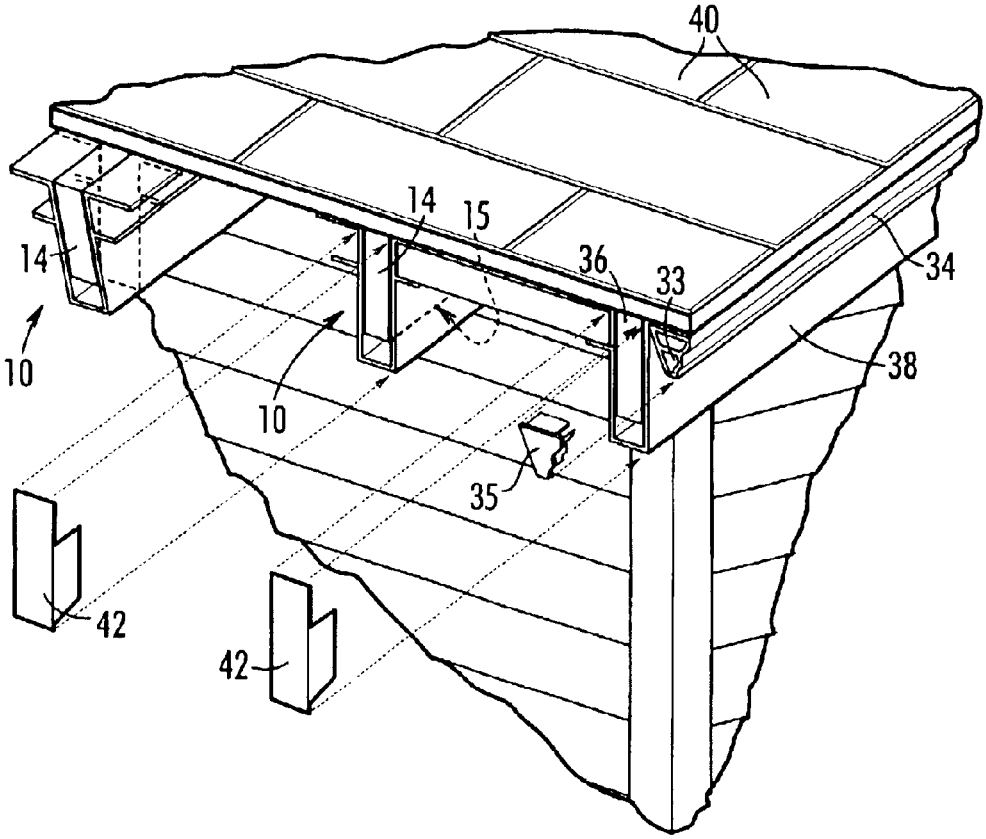
FIG. 2 is an operational view of rafter sleeves, showing a rafter sleeve covering a standard rafter, a rafter sleeve covering a barge rafter, soffit material, decorative molding, and endcaps, according to a preferred embodiment of the present invention.

Referring to FIGS. 1 and 2, the Rafter Sleeve 10 of the present invention is shown. In the embodiment shown, the Rafter Sleeve 10 is a U-shaped sleeve that has an interior channel 12 that runs the entire length of the Rafter Sleeve 10. Preferably, the Rafter Sleeve 10 can be used to protect, cover, and possibly decorate a substantial portion of a rafter tail 15, or, alternatively, can be used for performing the same functions while covering a substantial portion of the entire length of a rafter 14 from the place where a rafter 14 is attached to the ridge beam to a rafter's outer end 16.

Preferably the Rafter Sleeve 10 includes an upper flange 18 and a lower flange 20 attached to each vertical side 22 of the Rafter Sleeve 10. Each upper flange 18 and lower flange 20 attached to the same vertical side 22 form a flange pair 24 that extends away from the vertical side 22 to which that flange pair 24 is attached, and each flange pair 24 runs the entire length of the Rafter Sleeve 10. Preferably, the upper flange 18 and the lower flange 20 extend away from the vertical side 22 for a distance in the range of about 0.5 inches to about 8.0 inches, and a soffit channel 21 having a width in the range of about 0.5 to 2.0 inches is defined between their outwardly extending surfaces. Preferably the upper flange 18 is slightly wider than the lower flange 20 and, therefore, extends further away than the lower flange 20 from the vertical side 22 to which that flange pair 24 is attached. Preferably, as shown in FIG. 1, each upper flange 18 has longitudinally extending slots 25 formed near its outer edge 26, which are used for attaching the upper flange 18 and, therefore, the Rafter Sleeve 10 to the roof sheathing 28, or to some other connection location, after the Rafter Sleeve 10 has been properly placed to cover either a rafter 14, or a rafter tail 15, as desired. The slots 25 allow the installer some leeway in where to place an attaching and/or fastening device, and also allows for some expansion and/or contraction of the Rafter Sleeve 10. Preferably the Rafter Sleeve 10 is attached by using standard fasteners and/or attachment devices including, but not limited to, nails, screws, and staples; however, any other suitable fastener and/or attachment device can be used for attaching the Rafter Sleeve 10 to the other roofing or building materials and/or components. Preferably, the Rafter Sleeve 10 is fabricated of an essentially maintenance-free material such as extruded vinyl or aluminum; however, the Rafter Sleeve 10 can be fabricated of any plastic, polymeric, or metallic material, or any other suitable material that will be able to withstand the stresses associated with attaching the Rafter Sleeve 10 to the building, or the conditions associated with being exposed to the sun and weather. Preferably the Rafter Sleeve 10 can be fabricated so that it can have a variety of surfaces such as a smooth surface or a textured surface, and it may be made in a variety of colors. With respect to this, the texturing and coloring of the surface can be accomplished by any of the techniques that are well known in the art of vinyl siding and/or metal panel fabrication. Preferably, the Rafter Sleeve 10 will be available in many standard sizes, i.e., lengths and/or cross-sections, in order to cover all standard rafter 14 sizes and/or cross-sections, but, for ease in ordering Rafter Sleeves 10 for various building projects, the Rafter Sleeve 10 may also be available in a variety of other sizes and/or cross-sections as well. In this regard, the Rafter Sleeve 10 can be stocked and ordered in various lengths including, but not limited to, ten (10') foot or fourteen (14') foot lengths. From these longer lengths the Rafter Sleeve 10 can be cut into shorter segments such as twelve (12") inches to thirty-six (36") inches, and then used to cover the rafter tails 15. On the other hand, long segments of the present invention can be used to cover the barge rafters 36, i.e., the rafters at the gable ends of the roof. Hereinafter, when a Rafter Sleeve 10 is used to cover a barge rafter 36, it will be referred to as a Barge Rafter Sleeve 38. Preferably, the covering of the barge rafters 36 can be accomplished by relieving the corners of Barge Rafter Sleeve 38 sections and then joining and/or interlocking the Barge Rafter Sleeve 38 sections together by slipping one Barge Rafter Sleeve 38 section into the adjoining Barge Rafter Sleeve 38 section until the installer has covered the entire barge rafter 36. This is the same general technique that is used in the vinyl siding trade to join vinyl siding corner pieces together; however, any other suitable method for joining and/or interlocking the Barge Rafter Sleeve 38 sections together can be used.

Figure 4A:
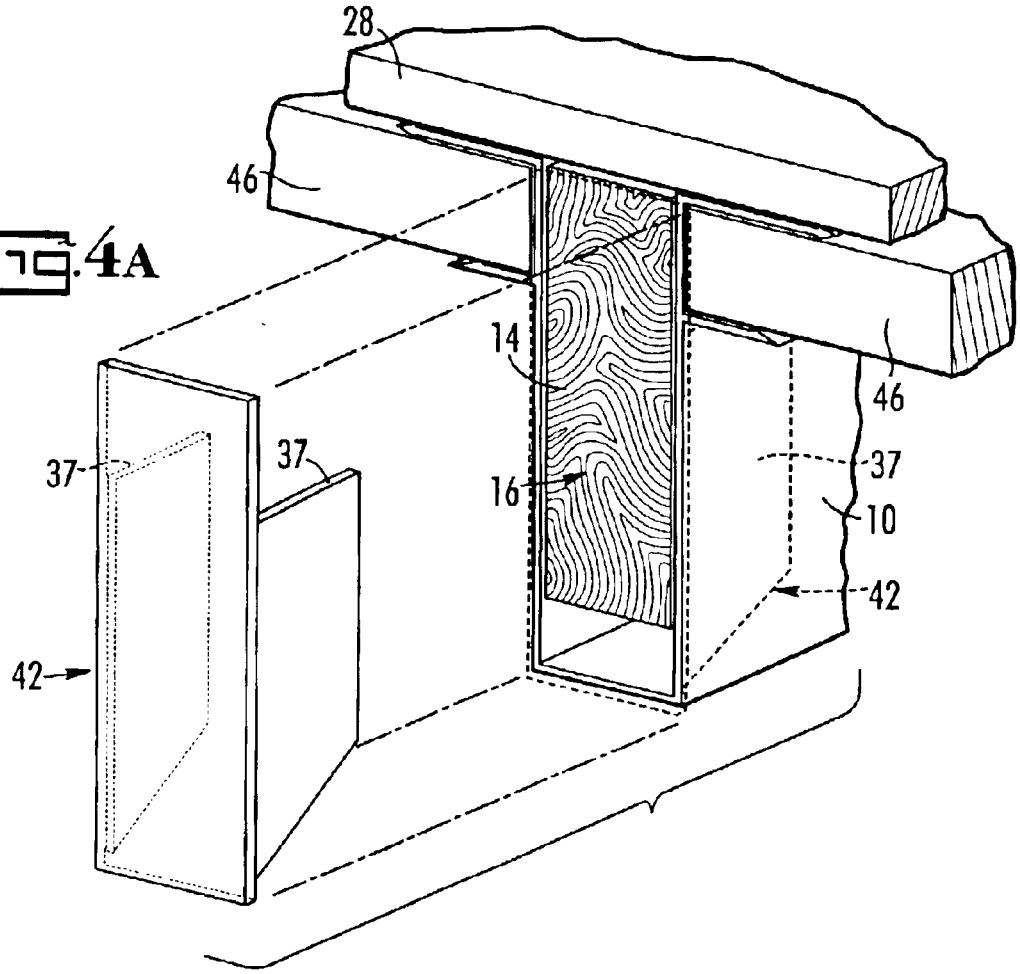
FIG. 4A is an exploded side perspective view of the rafter sleeve showing an endcap, according to a preferred embodiment of the present invention.

Referring now to FIG. 3A, an end view of a preferred embodiment of a Rafter Sleeve 10 and a Barge Rafter Sleeve 38 are shown. Referring now to FIGS. 2, 3A and 3B, also illustrated are the male connector ends 30 located on the outer edges of each upper flange 18 and each lower flange 20, and the female connector ends 32 attached to decorative trim molding 34 that, preferably, can be used with a Barge Rafter Sleeve 38 in order to cover a potential gap that can exist between the Barge Rafter Sleeve 38 and the bottom of the roof shingles 40 (and/or other roofing materials), and/or can be used to provide a decorative trim detail at the top edge of the Barge Rafter Sleeve 38 where the roof shingles 40 meet the barge rafter 36 and, therefore, the Barge Rafter Sleeve 38. Preferably a wide array of architectural styles, having varying degrees of ornateness and/or formality will be used in fabricating the decorative trim molding 34 profiles including, but not limited to, plain rectangular shingle molding, and simple or intricate crown molding. Preferably, the ends of the decorative trim molding 34 are covered by decorative trim molding endcaps 35, as shown in FIGS. 2, 3B, and 3C, rather than forming sleeves with closed ends. The snap-fit type connector ends 30 and 32 as shown in FIG. 3B are the preferred connectors; however, any other suitable means of attaching, fastening, and/or interlocking could be used including, but not limited to, interlocking pins, and hooks. Preferably the decorative trim molding endcap 35 is installed by cutting a ninety (90°) degree return on the decorative trim molding 34 and then inserting the flanges 39 of the decorative trim molding endcaps 35 into the open outer end 33 of the decorative trim molding 34 in a manner that would be similar to how a rafter sleeve endcap 42 would be installed as shown in FIG. 4A. Notably, since a ninety (90°) degree return would be the same regardless of the pitch of the roof, only one type of decorative trim molding endcap 35 would be required to be fabricated for each decorative trim molding 34 profile.

Figure 4B:
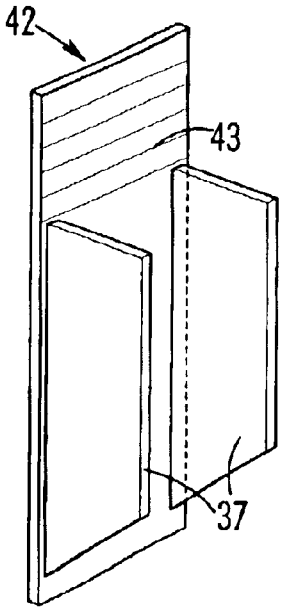
FIG. 4B is a side perspective view of the rafter sleeve endcap, according to a preferred embodiment of the present invention.

Referring now to FIG. 2, two rafters 14 and the Rafter Sleeves 10 covering the rafters 14, a barge rafter 36 and a Barge Rafter Sleeve 38 covering the barge rafter 36, along with rafter sleeve endcaps 42, which can be used on a Rafter Sleeve 10 and/or a Barge Rafter Sleeve 38, are shown. By referring to FIGS. 4A and 4B, a detailed view of a rafter sleeve endcap 42 and the flanges 37 of the rafter sleeve endcap 42 are shown. Shown in phantom in FIG. 4A is a Rafter Sleeve 10 with a rafter sleeve endcap 42 installed, which illustrates the preferred positioning of the flanges 37 of the rafter sleeve endcap 42 within the Rafter Sleeve 10. This would also be the preferred positioning of the flanges 37 in a Barge Rafter Sleeve 38, if that is where the rafter sleeve endcap 42 is being installed. Since different standard roof pitches range from 14/12, i.e., the height of the roof rises fourteen (14") inches over a distance of twelve (12") inches, or less, the rafter sleeve endcap 42 is designed to fit into and cover the outer end of any Rafter Sleeve 10 covering a rafter tail 15 having a pitch angle ranging from about 0/12 to about 14/12. Additionally, to assist in installation of the rafter sleeve endcap 42, the rafter sleeve endcap 42 has marks, preferably along its inner surface, that indicate where the rafter sleeve endcap 42 should be cut along the appropriate mark from among the marks for different standard roof pitches. Additionally, the rafter sleeve endcap 42 can even be used for roofs with a roof pitch that exceeds 14/12 by adding a trim piece such as a "J-Channel" or some other appropriate accessory piece at the shingle line.

Referring now to FIGS. 1–4B, a preferred method of installing the present invention will be described. An optional skirt board (not shown) is installed by notching it around all of the rafter tails and extending the skirt board for about several inches below the bottom of the rafter tails 15. Preferably if a skirt board is installed, the skirt board should be fabricated of plastic lumber, urethane molding, or other essentially maintenance-free material. There are a number of well known products made of these materials that are available for use as a skirt board; however, a skirt board is not necessary for use with or the installation of the present invention. The Rafter Sleeve 10 is then cut to the desired length, slid over the rafter tail 15, and affixed to the roof sheathing 28. The nails, screws or staples used for affixing the Rafter Sleeve 10 to the roof sheathing 28 are then installed through the nailing slots 25 about one-eight (⅛th) of an inch short of snug, which will allow for expansion and/or contraction of the Rafter Sleeve 10. Afterwards, soffit board 46 may be slid into the soffit channels 21, in the space between the rafter tails 15 underneath the roof sheathing 28, and, if desired, the soffit boad 46 can be affixed to the roof sheathing 28 by using nails, staples, or any other suitable means. Rafter sleeve endcaps 42 are then installed into, or onto, the outer ends 11 of the Rafter Sleeves 10 by cutting the top tab 43 to the length required to match the roof's pitch angle and sliding the flanges 37 of the rafter sleeve endcap 42 into the outer end of the Rafter Sleeve 10, and then permanently affixing the endcap 42 to the Rafter Sleeve 10. Also, if desired, a piece of J-Channel can be affixed to the lowest edge of the roof sheathing 28 by installing fasteners through the endcaps 42 and into the outer end 16 of the rafter 14 being covered by that endcap 42.

To cover the barge rafters 36, long lengths of Rafter Sleeve 10 are used to form Barge Rafter Sleeves 38, or, if required due to length considerations, by joining sections of the present invention together as previously described. Soffit board 46 may be fashioned by cutting a length of soffet material into segments and then each segment is a soffet board 46. Soffit board 46 is then applied to the eaves of the gables by installing one edge of the soffit board 46 into, or onto, a soffit channel 21 of a Barge Rafter Sleeve 38, and the other edge of the soffit material 46 into, or onto, a standard J-Channel or some other suitable nailing surface that is attached to the gable end's sheathing. Preferably, after installing the Barge Rafter Sleeve 38, the Barge Rafter Sleeve 38 should be detailed by installing decorative trim molding 34, which may be installed by snap-fitting the integral female connector ends 32 of the decorative trim molding 34 onto the integral male connector ends 30 of the upper flange 18 and the lower flange 20. Snap-fitting, as mentioned above, is the preferred method since it allows for a secure connection that has some play for expansion and/or contraction of the present invention and/or the other building materials to which the present invention is affixed; however, any other suitable connection method could be used that allows for contraction and/or expansion of the materials involved, or even connection methods that do not make such an allowance such as by securely nailing or screwing the components together may be used. After installing the decorative trim molding 34, which is miter cut at the ridge of the roof and given a ninety (90°) degree cut relative to the angle of the roof sheathing at or near the rafter tail end of the barge rafter 36 (or the outer end of the Barge Rafter Sleeve 38), a decorative trim molding endcap 35 is installed at the outer end 33 of the decorative trim molding 34 where the ninety (90°) degree cut was made.

The apparatus and the method used for installing the present invention are not limited to any specific configuration, shapes, or materials. In this regard, those skilled in the art of home building, or home siding fabrication and/or installation will find that the apparatus and/or the corresponding method(s) may be used in a variety of similar ways.

Therefore, while the preferred embodiments and the best mode of the present invention are described herein, it should be understood that the best mode for carrying out the invention herein described is by way of illustration and not by way of limitation. It is intended that the scope of the present invention includes all modifications that incorporate its principal design features, and that the scope and limitations of the present invention are to be determined by the scope of the appended claims and their equivalents.

What is claimed is:

1. An apparatus, comprising:

a rafter having an exposed end;

a U-shaped sleeve defining an interior channel dimensioned to receive said exposed end of said rafter, said U-shaped sleeve having an end, and means formed therein for receiving a soffit board;

a soffit board received by soffit receiving means of said U-shaped sleeve; and an endcap formed to fit into and cover only said end of said U-shaped sleeve to close said end of said U-shaped sleeve and thereby cover said exposed end of said rafter when said rafter is received within said interior channel so that said U-shaped sleeve and said endcap maintain the appearance of a rafter tail.

2. The apparatus as recited in claim 1, wherein said U-shaped sleeve has means formed thereon for receiving molding.

3. The apparatus as recited in claim 2, wherein said article further comprises molding received by molding receiving means of said U-shaped channel.

4. The apparatus for use with exposed rafters of a roof, said roof having plural rafters, each rafter of said plural rafters having an exposed end, said article comprising:

a length of U-shaped sleeve defining an interior channel, said length of said U-shaped sleeve, when cut into segments so that each segment has an end, being dimensioned to receive and cover plural exposed end of a rafter of a roof, each segment of said U-shaped sleeve having an end;

plural endcaps, each endcap of said plural endcaps being formed to be received by said each segment of said U-shaped sleeve and thereby close said end of said segments of said U-shaped sleeve and to cover said exposed end of said rafter when said rafter is received within said interior channel;

a length of molding attachable to said U-shaped sleeve; and molding endcaps, each molding endcap of said molding endcaps being attachable to said molding.

5. The apparatus as recited in claim 4, wherein said U-shaped sleeve has means formed thereon for receiving soffit.

6. The apparatus as recited in claim 5, wherein said U-shaped sleeve has an upper flange and a spaced-apart lower flange, said upper flange and said lower flange defining a soffit channel therebetween.

7. The apparatus as recited in claim 6 wherein said upper flange is wider than said lower flange.

8. The apparatus as recited in claim 7, wherein said upper flange has plural slots formed therein.

9. The apparatus as recited in claim 4, wherein said U-shaped sleeve carries an upper flange for securing said U-shaped channel to a roof.

10. The apparatus as recited in claim 9, wherein said upper flange has slots formed therein.

11. The apparatus as recited in claim 4, wherein said each endcap of said plural endcaps is marked to permit cutting to fit said each end of said plural segments, each marking of said markings corresponding to a different standard roof pitch.

12. The apparatus as recited in claim 4, wherein said U-shaped sleeve has an upper flange and a spaced apart lower flange and said molding is formed to receive said upper flange and said lower flange, thereby to secure said molding to said U-shaped sleeve.

13. The apparatus as recited in claim 12, wherein said U-shaped sleeve, said plural endcaps, said molding and said molding endcaps are made of a material selected from the group consisting of aluminum and vinyl.

14. The apparatus as recited in claim 4, further comprising a length soffit said soffit being cuttable into soffit segments, and wherein said U-shaped channel is formed to receive soffit segments.

15. The apparatus as recited in claim 4, wherein said interior channel and said plural endcaps are dimensioned to be larger than said rafter.

16. A roof, comprising:

plural rafters, each rafter of said plural rafters having an exposed end;

sheathing fastened to said plural rafters;

shingles fasted to said sheathing;

U-shaped sleeves receiving said exposed ends of said plural rafters and attached to said sheathing, wherein said U-shaped sleeves have upper flanges and spaced apart lower flanges, said upper flanges and said lower flanges defining soffet channels therebetween;

molding attached to the last rafter of said plural rafters; and soffet boards received in said soffet channels.

17. The roof as recited in claim 16, wherein said U-shaped sleeves and said molding are made from a material selected from the group consisting of aluminum and vinyl.

18. An apparatus, comprising:

a rafter having an exposed end;

a U-shaped sleeve defining an interior channel dimensioned to receive said exposed end of said rafter, said U-shaped sleeve having an end, wherein said U-shaped sleeve has means formed thereon for receiving molding;

an endcap formed to fit into and cover only said end of said U-shaped sleeve to close said end of said U-shaped sleeve and thereby cover said exposed end of said rafter when said rafter is received within said interior channel so that said U-shaped sleeve and said endcap maintain the appearance of a rafter tail; and molding received by molding receiving means of said U-shaped channel.

* * * * *